US011107625B2

(12) United States Patent
Sumitomo et al.

(10) Patent No.: US 11,107,625 B2
(45) Date of Patent: Aug. 31, 2021

(54) IGNITION COIL DEVICE FOR INTERNAL COMBUSTION ENGINE

(71) Applicant: Mitsubishi Electric Corporation, Tokyo (JP)

(72) Inventors: Yuma Sumitomo, Tokyo (JP); Nobuyuki Sawazaki, Tokyo (JP); Mitsuharu Hashiba, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/763,307

(22) PCT Filed: Dec. 19, 2017

(86) PCT No.: PCT/JP2017/045527
§ 371 (c)(1),
(2) Date: May 12, 2020

(87) PCT Pub. No.: WO2019/123533
PCT Pub. Date: Jun. 27, 2019

(65) Prior Publication Data

US 2020/0312543 A1 Oct. 1, 2020

(51) Int. Cl.
*F02P 15/00* (2006.01)
*H01F 38/12* (2006.01)
(Continued)

(52) U.S. Cl.
CPC ..... *H01F 38/12* (2013.01); *F02P 3/02* (2013.01); *H01F 7/064* (2013.01)

(58) Field of Classification Search
None
See application file for complete search history.

(56) References Cited

U.S. PATENT DOCUMENTS 5,295,861 A * 3/1994 Peretick ..... H01F 38/12 123/647
5,359,982 A * 11/1994 Taruya ..... F02P 3/02 123/634
(Continued)

FOREIGN PATENT DOCUMENTS

JP 3385313 B2 3/2003
JP 2007-081085 A 3/2007
(Continued)

OTHER PUBLICATIONS

International Search Report for PCT/JP2017/045527 dated Apr. 3, 2018 [PCT/ISA/210].

*Primary Examiner* — Stephen W Jackson
(74) *Attorney, Agent, or Firm* — Sughrue Mion, PLLC; Richard C. Turner

(57) ABSTRACT

Provided is an ignition coil device for an internal combustion engine, including: an insulating case; an ignition coil device main body accommodated inside the insulating case, the ignition coil device main body including: a coil assembly; a center core arranged on an inner side of the coil assembly along a center axis of the coil assembly; a side core arranged on an outer side of the center core and the coil assembly; and an elastic cover provided to the side core; an igniter, which is accommodated inside the insulating case; and a filler, which is provided so as to fill the insulating case and is hardened, wherein the elastic cover includes: a covering portion configured to cover the side core; and a protruding portion, which protrudes from the covering portion, and is configured to relax a stress generated in the filler.

7 Claims, 4 Drawing Sheets

(51) Int. Cl.
*F02P 3/02* (2006.01)
*H01F 7/06* (2006.01)

(56) References Cited

U.S. PATENT DOCUMENTS 6,980,073 B2 * 12/2005 Wada ..... H01F 27/022
336/90
9,627,124 B2 * 4/2017 Satoh ..... B29C 45/14639
9,659,703 B2 5/2017 Kawai

FOREIGN PATENT DOCUMENTS

JP 4658168 B2 3/2011
JP 2013-065743 A 4/2013
JP 5677247 B2 2/2015
JP 2016-048719 A 4/2016

* cited by examiner

IGNITION COIL DEVICE FOR INTERNAL COMBUSTION ENGINE

CROSS REFERENCE TO RELATED APPLICATIONS

This application is a National Stage of International Application No. PCT/JP2017/045527 filed Dec. 19, 2017.

TECHNICAL FIELD

The present invention relates to an ignition coil device for an internal combustion engine, which is configured to supply a high voltage to an ignition plug of an internal combustion engine.

BACKGROUND ART

There has hitherto been known an ignition coil device for an internal combustion engine, which has an insulating resin being a filler that is filled in an insulating case accommodating an ignition coil and an igniter. The ignition coil includes a center core, a coil assembly, and a side core. The coil assembly surrounds an outer periphery of the center core. The side core is arranged on an outer side of the center core and the coil assembly. The ignition coil device is configured to boost an input voltage to a high voltage. The igniter includes electronic components. Further, the igniter is configured to allow and interrupt a flow of a current to the coil assembly.

The ignition coil device for an internal combustion engine is subjected to an ambient temperature change in a usage environment. Thus, the filler in the insulating case shrinks and expands. The filler and other components have different linear expansion coefficients. Thus, a stress is repeatedly generated due to the shrinkage and the expansion of the filler. The stress is repeatedly applied to the igniter and the ignition coil. The electronic components built in the igniter may be damaged by the repeatedly applied stress. When any one of the electronic components built in the igniter is damaged, the igniter cannot allow and interrupt a flow of a current to the ignition coil.

In view of the problem described above, an ignition coil device for an internal combustion engine which is described in Patent Literature 1 has been proposed. In the related-art ignition coil device for an internal combustion engine which is described in Patent Literature 1, the side core is covered with an elastic cover. With use of the elastic cover, the stress generated in the filler can be reduced.

In the related-art ignition coil device for an internal combustion engine which is described in Patent Literature 1, the igniter overlaps with the coil assembly when viewed along a direction of a center axis of the coil assembly. In view of arrangement of a terminal wiring configured to connect the coil assembly and the igniter to each other, however, the igniter is arranged so as to be apart in a plane direction of an outer peripheral surface of the side core in some cases. In the case of such a structure, the igniter may be damaged due to an influence of the stress generated by the shrinkage and the expansion of the filler, which is present between the coil assembly and the igniter.

Further, there arises a risk of causing separation of the filler from the coil assembly or generation of a crack in the filler due to the stress generated by the shrinkage and the expansion of the filler. When the separation of the filler from the coil assembly or the generation of a crack in the filler occurs, internal discharge occurs through the separation or the crack. As a result, reliability of the ignition coil is lowered.

The problems described above become more conspicuous as a volume of the filler increases along with an increase in coil size. This is because the increase in volume of the filler causes an increase in the amount of shrinkage and the amount of expansion of the filler along with the ambient temperature change.

CITATION LIST

Patent Literature

[PTL 1] JP 4658168 B2

SUMMARY OF INVENTION

Technical Problem

The present invention has an object to solve the problems described above. Specifically, the present invention has an object to provide an ignition coil device for an internal combustion engine, with which reliability can be improved.

Solution to Problem

According to one embodiment of the present invention, there is provided an ignition coil device, including: an insulating case; an ignition coil device main body accommodated inside the insulating case, the ignition coil device main body including: a coil assembly; a center core arranged on an inner side of the coil assembly along a center axis of the coil assembly; a side core arranged on an outer side of the center core and the coil assembly; and an elastic cover provided to the side core; an igniter, which is accommodated inside the insulating case, and is configured to control energization of the coil assembly; and a filler, which is provided so as to fill the insulating case and is hardened, wherein the elastic cover includes: a covering portion configured to cover the side core; and a protruding portion, which protrudes from the covering portion, and is configured to relax a stress generated in the filler.

Advantageous Effects of Invention

According to the embodiment of the present invention, the covering portion configured to cover the side core has the protruding portion, and hence the stress generated by shrinkage and expansion of the filler is relaxed. As a result, the reliability of the ignition coil device is improved.

DESCRIPTION OF EMBODIMENT

Figure 1:
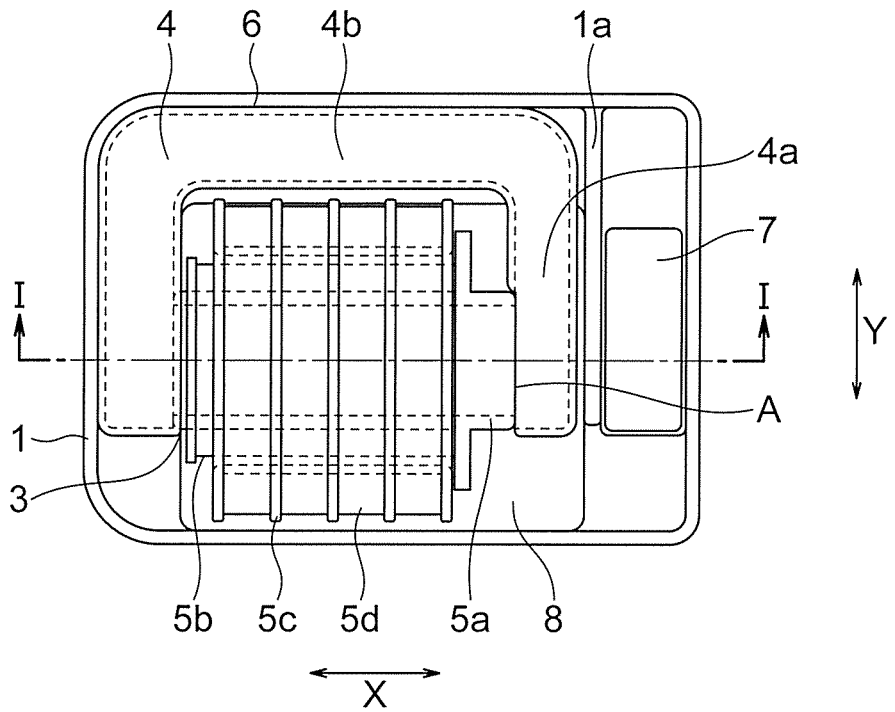
FIG. 1 is a top view for illustrating an ignition coil device for an internal combustion engine according to an embodiment of the present invention.

FIG. 1 is a top view for illustrating an ignition coil device for an internal combustion engine according to an embodiment of the present invention. Further, FIG. 2 is a sectional view taken along the line I-I of FIG. 1.

In FIG. 1, a width direction X of the ignition coil device matches with a right-and-left direction of FIG. 1. Further, in FIG. 1, a depth direction Y of the ignition coil device matches with an up-and-down direction of FIG. 1. In FIG. 1, a front side of the ignition coil device is illustrated on a lower side, and a rear side of the ignition coil device is illustrated on an upper side.

Figure 2:
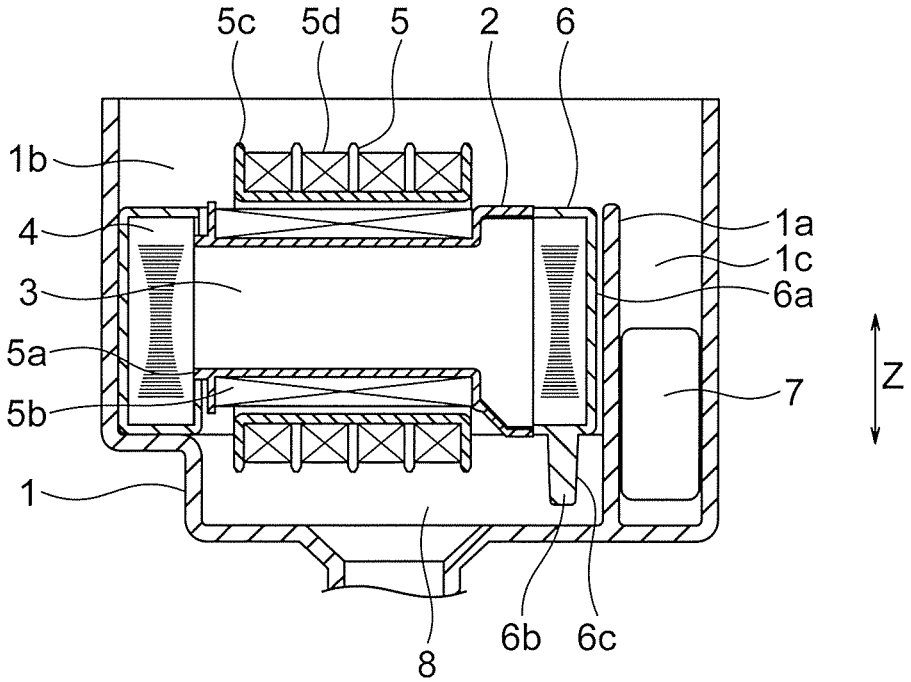
FIG. 2 is a sectional view taken along the line I-I of FIG. 1.

In FIG. 2, a thickness direction Z of the ignition coil device matches with an up-and-down direction of FIG. 2. In FIG. 2, one side of the ignition coil device in the thickness direction is illustrated on a lower side of FIG. 2, and another side of the ignition coil device in the thickness direction is illustrated on an upper side of FIG. 2.

A direction in which the ignition coil device according to the present invention is mounted into a vehicle is not limited to that determined based on the above-mentioned definitions of directions illustrated in FIG. 1 and FIG. 2.

The ignition coil device for an internal combustion engine according to the present invention includes an insulating case 1, an ignition coil device main body 2, an igniter 7, and a filler 8.

The insulating case 1 is made of an insulating material. The ignition coil device main body 2, the igniter 7, and the filler 8 are accommodated in the insulating case 1.

Inside the insulating case 1, a partition wall 1*a* made of an insulator, which is formed integrally with the insulating case 1, is arranged. The partition wall 1*a* is formed to extend upright from an inner wall of the insulating case 1 so as to partition an internal space of the insulating case 1. On both sides of the partition wall 1*a*, a first space 1*b* and a second space 1*c* are defined. The partition wall 1*a* does not completely partition the internal space of the insulating case 1. Thus, the first space 1*b* and the second space 1*c* are not completely separated from each other by the partition wall 1*a*, and are partially continuous with each other. The ignition coil device main body 2 is arranged in the first space 1*b*. The igniter 7 is arranged in the second space 1*c*. The second space 1*c* is located between a wall for forming the insulating case 1 and the partition wall 1*a*. Specifically, the igniter 7 is arranged between the wall of the insulating case 1 and the partition wall 1*a*.

The ignition coil device main body 2 includes a center core 3, a side core 4, a coil assembly 5, and an elastic cover 6. The ignition coil device main body 2 is configured to boost an input voltage to a high voltage.

The coil assembly 5 includes a primary bobbin 5*a*, a primary coil 5*b*, a secondary bobbin 5*c*, and a secondary coil 5*d*. The primary coil 5*b* is provided on an outer periphery of the primary bobbin 5*a* having a cylindrical shape. The secondary coil 5*d* is provided on an outer periphery of the secondary bobbin 5*c* having a cylindrical shape. The secondary bobbin 5*c* is arranged on an outer side of the primary bobbin 5*a*. The primary bobbin 5*a* and the secondary bobbin 5*c* have a common center axis. The coil assembly 5 has a double structure including the primary bobbin 5*a* as an inner cylinder and the secondary bobbin 5*c* as an outer cylinder. A direction of the center axis of the coil assembly 5 matches with the width direction X of the ignition coil device.

The center core 3 is made of a magnetic material and has a rod-like shape. The center core 3 is arranged on an inner side of the coil assembly 5. Further, the center core 3 is arranged along the direction of the center axis of the coil assembly 5. The center core 3 is configured to magnetically couple the primary coil 5*b* and the secondary coil 5*d* to each other. With the magnetic coupling, the voltage can be effectively boosted.

The side core 4 is made of a magnetic material. As illustrated in FIG. 1, the side core 4 is formed to have a C-like overall shape. The side core 4 has a pair of first core portions 4*a* and a second core portion 4*b*. The pair of first core portions 4*a* extend so as to be opposed to both ends of the center core 3. The second core portion 4*b* couples the pair of first core portions 4*a* to each other. The side core 4 is arranged on an outer side of the center core 3 and the coil assembly 5.

The pair of first core portions 4*a* are arranged on the outer side of the center core in the direction of the center axis of the coil assembly 5. With the arrangement described above, the center core 3 is located between the pair of first core portions 4*a* in the direction of the center axis of the coil assembly 5. The second core portion 4*b* is arranged in parallel to the center core 3. The pair of first core portions 4*a* extend from both ends of the second core portion 4*b* to such an extent as to be opposed to both ends of the center core 3. Further, the pair of first core portions 4*a* extend from the ends of the second core portion 4*b* in a direction perpendicular to the second core portion 4*b*. The side core 4 formed as described above is arranged so as to surround the center core 3 and the coil assembly 5.

Now, the thickness direction Z of the ignition coil device is described. The thickness direction Z of the ignition coil device is orthogonal to the width direction X of the coil assembly 5. The pair of first core portions 4*a* and the second core portion 4*b* are arranged on a plane orthogonal to the thickness direction Z of the ignition coil device. Further, the depth direction Y of the ignition coil device is orthogonal to both of the width direction X and the thickness direction Z. Each of the pair of first core portions 4*a* is arranged along the depth direction Y of the ignition coil device.

The elastic cover 6 is provided to the side core 4. Further, the elastic cover 6 is made of an elastic material. The elastic material for forming the elastic cover 6 is, for example, a thermoplastic elastomer.

The elastic cover 6 includes a covering portion 6*a* and a protruding portion 6*b*. The covering portion 6*a* is configured to cover the side core 4. The protruding portion 6*b* protrudes from the covering portion 6*a*. A part of the side core 4 is exposed to an outside without being covered with the covering portion 6*a*. The part of the side core 4, which is not covered with the covering portion 6*a*, corresponds to portions of the pair of first core portions 4*a*, which are respectively opposed to both end surfaces of the center core 3. The portion of each of the first core portions 4*a*, which is opposed to a corresponding one of the end surfaces of the center core 3, is a region A in FIG. 3. The covering portion

6*a* is formed over a surface of the side core 4 by insert molding. The side core 4 forms a closed magnetic circuit with the center core 3.

The protruding portion 6*b* is formed on a portion of the covering portion 6*a*, which corresponds to one of the first core portions 4*a* of the side core 4. The protruding portion 6*b* is arranged on a surface of the corresponding first core portion 4*a* on the one side in the thickness direction Z. Further, the protruding portion 6*b* protrudes from the covering portion 6*a* along the thickness direction Z of the ignition coil device.

The igniter 7 includes electronic components. Further, the igniter 7 is arranged on an outer side of one of the first core portions 4*a* in the direction of the center axis of the coil assembly 5. The igniter 7 is configured to control energization of the coil assembly 5. Specifically, the igniter 7 is configured to allow and interrupt a flow of a current through the coil assembly 5.

Figure 3:
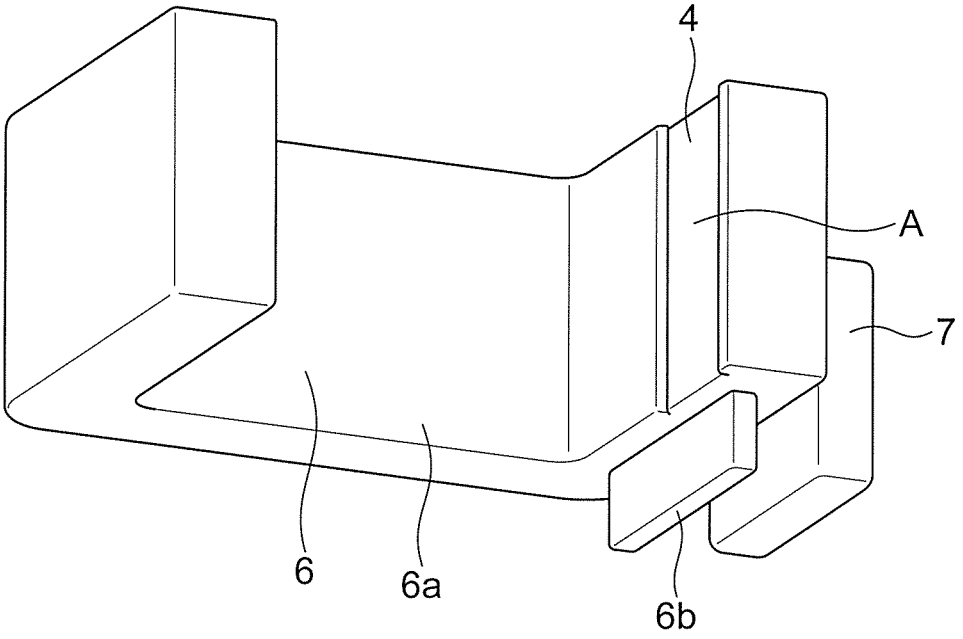
FIG. 3 is a perspective view for illustrating a positional relationship between a protruding portion and an igniter of FIG. 2.
Figure 4:
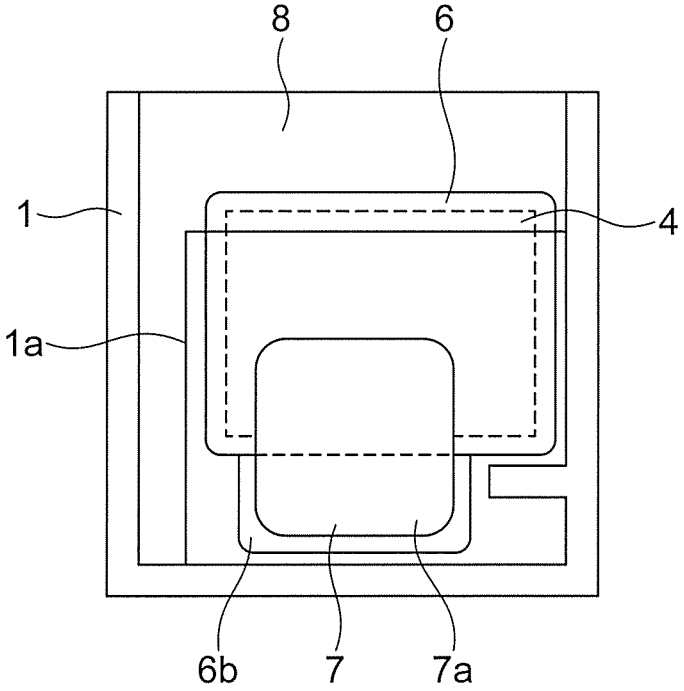
FIG. 4 is a side view for illustrating a positional relationship among a partition wall, an ignition coil device main body, and the igniter of FIG. 3.

The arrangement of the igniter 7 is now described. FIG. 3 is a perspective view for illustrating a positional relationship between the protruding portion 6*b* and the igniter 7 of FIG. 2. FIG. 4 is a side view for illustrating a positional relationship among the partition wall 1*a*, the ignition coil device main body 2, and the igniter 7 of FIG. 3. When the ignition coil device is viewed along the width direction X, a part of the igniter 7 projects beyond the covering portion 6*a*. The part of the igniter 7, which projects beyond the covering portion 6*a*, is a projecting portion 7*a*. The above-mentioned arrangement is described with reference to FIG. 2 to FIG. 4. The igniter 7 is arranged so as to be apart toward the one side in the thickness direction Z with respect to the side core 4. As a result, a position of a surface of the igniter 7 on the one side in the thickness direction Z is located so as to be apart toward the one side in the thickness direction Z with respect to a position of a surface of the covering portion 6*a* arranged on the surface of the side core 4 on the one side in the thickness direction Z. Specifically, when the ignition coil device is viewed along the width direction X, as illustrated in FIG. 4, a portion of a region of the igniter 7, which projects beyond a lower end of a region of the covering portion 6*a* in the thickness direction Z of the ignition coil device, corresponds to the projecting portion 7*a*.

The insulating case 1 is filled with a filler 8, which is hardened therein. A material of the filler 8 is, for example, a thermosetting epoxy resin.

Next, a positional relationship between the protruding portion 6*b* and the igniter 7 is described. The protruding portion 6*b* is arranged between the coil assembly 5 and the igniter 7 in the width direction X of the ignition coil device. Further, when the protruding portion 6*b* is viewed along the width direction X of the ignition coil device, the protruding portion 6*b* is arranged so as to overlap with at least a part of the projecting portion 7*a*. The projecting portion 7*a* may entirely overlap with the protruding portion 6*b* when viewed along the width direction X. As an area of the protruding portion 6*b*, which overlaps with the igniter 7, is larger, a greater protecting effect for the igniter 7 is attained.

The protruding portion 6*b* is arranged along the depth direction Y of the ignition coil device. The protruding portion 6*b* has a plate-like shape. At least any one of side surfaces 6*c* of the protruding portion 6*b* is parallel to a surface of the igniter 7 on the side core 4 side.

A positional relationship in the width direction X between the side surface 6*c* of the protruding portion 6*b* on the igniter 7 side and a side surface of the covering portion 6*a* on the igniter 7 side is described.

Figure 5:
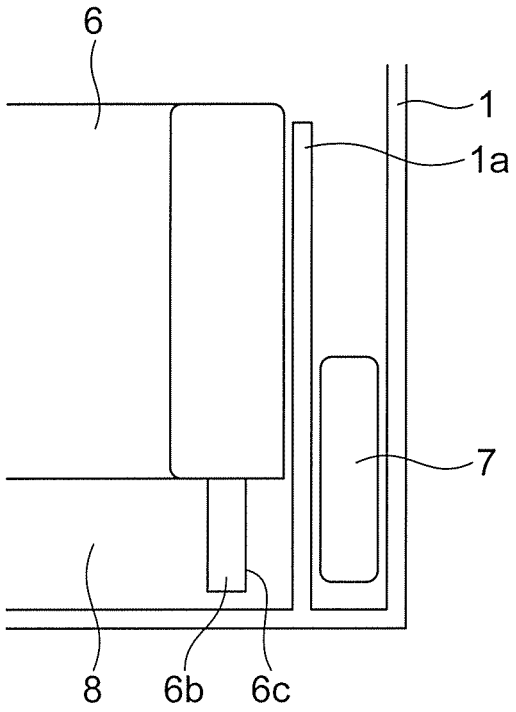
FIG. 5 is a side view for illustrating the positional relationship among the partition wall, the ignition coil device main body, and the igniter of FIG. 3.

FIG. 5 is an enlarged front view for illustrating a positional relationship between the protruding portion 6*b* and the covering portion 6*a*. When the protruding portion 6*b* is deformed due to thermal shrinkage at the time of molding, contact of the protruding portion 6*b* with the partition wall 1*a* may occur at the time of assembly into the insulating case 1 in some cases. When the contact of the protruding portion 6*b* with the partition wall 1*a* occurs, the ignition coil device main body 2 is less easily assembled into the insulating case 1, and there arises a risk of occurrence of a failure in assembly work for the ignition coil device. Thus, it is required that the contact of the protruding portion 6*b* with the partition wall 1*a* be prevented even when the protruding portion 6*b* is deformed. Hence, in this embodiment, as illustrated in FIG. 5, the side surface 6*c* of the protruding portion 6*b* on the igniter 7 side is offset toward the center core 3 side from a surface of a portion of the covering portion 6*a*, which corresponds to the side surface of the side core 4 on the igniter 7 side. With the configuration described above, the contact between the protruding portion 6*b* and the partition wall 1*a* can be avoided at the time of assembly. As a result, the ignition coil device with excellent ease of assembly can be achieved.

In the following, the protruding portion 6*b* is further described.

A length of the protruding portion 6*b* is described. The length of the protruding portion 6*b* corresponds to a distance from the surface of the covering portion 6*a* to a distal end of the protruding portion 6*b*. The distance is set so as to be equal to or larger than any larger one of a distance from a surface of a portion of the covering portion 6*a*, which corresponds to the surface of the side core 4 on the one side, to the surface of the igniter 7 on the one side and a distance from the surface of the portion of the covering portion 6*a*, which corresponds to the surface of the side core 4 on the one side, to an outermost portion of the coil assembly 5 on the one side in the thickness direction Z. With the dimension described above, a protecting effect for the igniter 7 and the coil assembly 5 from a stress generated due to shrinkage and expansion of the filler can be increased.

A dimension of the protruding portion 6*b* in the depth direction Y of the ignition coil device is set equal to or larger than a dimension of the igniter 7 in the depth direction Y. Specifically, when viewed along the width direction X, the igniter 7 falls within a range of the protruding portion 6*b* in the depth direction Y. With the structure described above, the protecting effect for the igniter 7 from the stress generated due to the shrinkage and the expansion of the filler can be further increased.

In the ignition coil device having the configuration described above, the protruding portion 6*b* configured to relax the stress generated in the filler 8 is arranged on the covering portion 6*a*. Thus, even when the filler 8 shrinks and expands, the stress generated in the filler 8 can be reliably relaxed by the protruding portion 6*b*. As a result, the igniter 7 can be more reliably protected.

Further, the stress generated due to the shrinkage and the expansion of the filler 8 can be relaxed, and hence separation of the filler 8 from the coil assembly 5 and generation of a crack in the filler 8 can be prevented. As a result, the coil assembly 5 can be more reliably protected.

Further, a part of a volume of the filler 8 in the ignition coil device can be replaced by an elastomer, which is the material of the protruding portion 6*b*. With the replacement described above, the volume of the filler 8 can be reduced. Even the reduction in volume of the filler 8 contributes to reduction in the amount of shrinkage and the amount of expansion of the filler 8. Thus, the separation of the filler 8 and the generation of a crack in the filler 8 can be prevented.

With the advantages described above, the igniter 7 and the coil assembly 5 can be more reliably protected, and hence the reliability of the ignition coil device can be improved.

Further, the protruding portion 6*b* is arranged on a portion of the covering portion 6*a*, which corresponds to one of the first core portions 4*a* on a side closer to the igniter 7. Thus, the protruding portion 6*b* can be arranged between the igniter 7 and the coil assembly 5. As a result, the stresses, which are respectively applied to the igniter 7 and the coil assembly 5 when the filler 8 shrinks and expands, can be effectively relaxed.

Further, when the ignition coil device main body 2 is viewed along the width direction, at least a part of the protruding portion 6*b* overlaps with the projecting portion 7*a* of the ignitor 7. Thus, the stress generated due to the shrinkage and the expansion of the filler can be reliably reduced by the protruding portion 6*b*. Accordingly, the stress applied to the ignitor 7 when the filler 8 shrinks and expands can be more reliably relaxed.

Further, when the ignition coil device main body 2 is viewed along the width direction, the projecting portion 7*a* of the igniter 7 entirely overlaps with the protruding portion 6*b*. Thus, the stress, which is applied to the igniter 7 when the filler 8 shrinks and expands, can be more reliably relaxed.

Further, at least any one of the side surfaces of the protruding portion 6*b* having the plate-like shape is parallel to the surface of the igniter 7 on the side core 4 side. Thus, the igniter 7 can be protected with the entire plate-shaped surface of the protruding portion 6*b*. Accordingly, the stress, which is applied to the igniter 7 when the filler 8 shrinks and expands, can be further reliably relaxed.

Further, the side surface of the protruding portion 6*b* on the igniter 7 side is offset from the surface of the covering portion 6*a* on the igniter 7 side toward the center core 3 side. Thus, even in a case in which the protruding portion 6*b* is deformed at the time of molding, when the ignition coil device main body 2 is assembled into the insulating case 1, contact of the protruding portion 6*b* with the partition wall 1*a* can be prevented. Thus, improvement in efficiency of assembly work for the ignition coil device can be achieved.

Further, the protruding portion 6*b* is arranged between the igniter 7 and the coil assembly 5. Thus, both of the igniter 7 and the coil assembly 5 can be effectively protected from the stress generated due to the shrinkage and the expansion of the filler 8.

Figure 6:
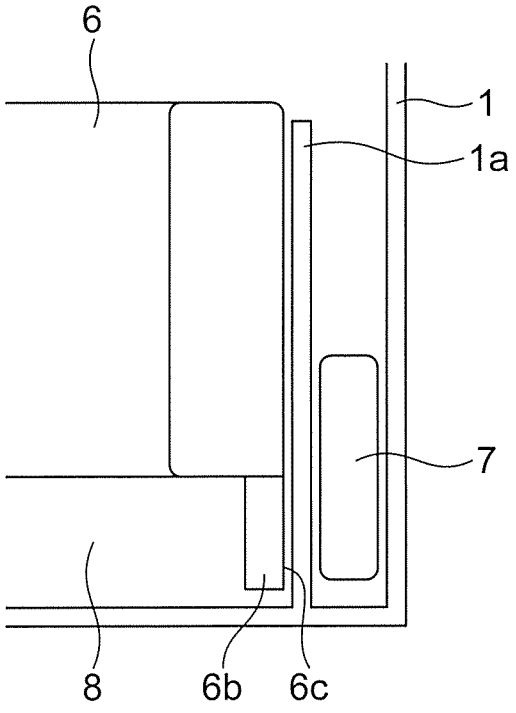
FIG. 6 is a side view for illustrating an example in which a side surface of a protruding portion on an igniter side and a surface of a covering portion for a side core on the igniter side are arranged so as to be flush with each other in the embodiment of the present invention.

In the embodiment described above, the side surface of the protruding portion 6*b* on the igniter 7 side is offset from the surface of the covering portion 6*a* on the igniter 7 side toward the center core 3 side. As illustrated in FIG. 6, however, the protruding portion 6*b* may be arranged so that the side surface of the protruding portion 6*b* on the igniter 7 side is flush with the surface of the covering portion 6*a* on the igniter 7 side. In this manner, a distance between the protruding portion 6*b* and the igniter 7 can be reduced. As a result, the amount of the filler 8, which is present between the protruding portion 6*b* and the igniter 7, can be reduced. With the reduction in the amount of the filler 8, the stress, which is applied to the igniter 7 due to the shrinkage and the expansion of the filler 8, can be reduced.

The dimension of the protruding portion 6*b* in the depth direction Y of the ignition coil device may be set equal to or larger than a dimension of the coil assembly 5 in the depth direction Y. Specifically, when viewed along the width direction X, the coil assembly 5 may fall within the range of the protruding portion 6*b* in the depth direction Y. With the structure described above, the protecting effect for the coil assembly 5 from the stress generated due to the shrinkage and the expansion of the filler can be further increased.

Further, the dimension of the protruding portion 6*b* in the depth direction Y of the ignition coil device may be set equal to or larger than any larger one of the dimension of the igniter 7 in the depth direction Y and the dimension of the coil assembly 5 in the depth direction Y. Specifically, when viewed along the width direction X, the igniter 7 and the coil assembly 5 may fall within the range of the protruding portion 6*b* in the depth direction Y. With the dimension described above, the protecting effect for the coil assembly 5 and the igniter 7 from the stress generated due to the shrinkage and the expansion of the filler can be further increased.

Further, in the embodiment described above, one protruding portion 6*b* protrudes from the covering portion 6*a*. However, the number of the protruding portion 6*b* is not limited to one. For example, a plurality of protruding portions 6*b* may be arranged on a portion of the covering portion 6*a*, which corresponds to the surface of the first core portion 4*a* on the one side in the thickness direction Z. Further, the protruding portion 6*b* may be arranged on a portion of the covering portion 6*a*, which corresponds to a surface of the first core portion 4*a* other than the surface of the first core portion 4*a* on the one side in the thickness direction Z. For example, the protruding portion 6*b* may be arranged on a portion of the covering portion 6*a*, which corresponds to any one of the surface of the first core portion 4*a* on the another side in the thickness direction Z and a front surface of the first core portion 4*a* in the depth direction Y.

Further, the number of protruding portions 6*b* to be formed may be determined for each of the surfaces. Specifically, the number of protruding portions 6*b* arranged on the surface of the covering portion 6*a* on the one side and the number of protruding portions 6*b* arranged on the surface of the covering portion 6*a* on the another side in the thickness direction Z may be set different from each other. For example, the number of protruding portions 6*b* may be set to two for the surface of the covering portion 6*a* on the one side and one for the surface of the covering portion 6*a* on the another side in the thickness direction Z. With the number of protruding portions 6*b* set as described above, the protecting effect for the igniter 7 and the coil assembly 5 can be further increased.

Further, in view of ease of molding with use of a die, the protruding portion 6*b* may be formed with draft so as to be tapered toward a distal end side. The draft is set to fall within a range of, for example, from 0.5° to 2°. When the protruding portion 6*b* is formed with the draft, the protruding portion 6*b* can be more easily molded. When the protruding portion 6*b* is formed with the draft, the protruding portion 6*b* can be formed so as to have a center line parallel to the side surface of the igniter 7.

Each of corners at the distal end of the protruding portion 6*b* may be a rounded corner R. A radius of the rounded corner R is set to, for example, R1 to R5. With the rounded corners, the generation of a crack in a part of the filler 8, which is in contact with the corners of the protruding portion 6*b*, can be prevented.

Figure 7:
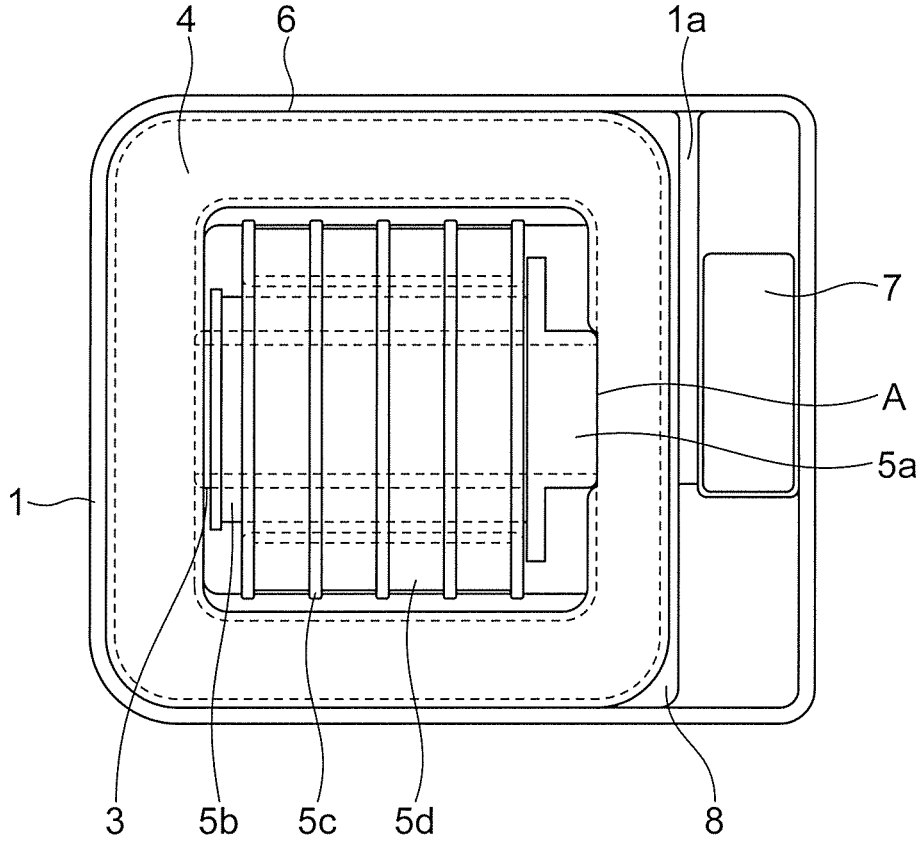
FIG. 7 is a top view for illustrating an O-shaped ignition coil device in which the side core has such a shape as to surround the entire periphery of a coil assembly in the embodiment of the present invention.

In the embodiment described above, the ignition coil device using the side core 4 having the C-like shape has been described. However, the shape of the side core 4 is not limited to the C-like shape. For example, as illustrated in FIG. 7, the shape of the side core 4 may be an O-like shape, which surrounds an entire periphery of the center core 3 and the coil assembly 5.

In the present invention, the embodiments described above may be freely combined with each other, or appropriately changed or omitted without departing from the scope of the present invention.

REFERENCE SIGNS LIST

1 insulating case, 1*a* partition wall, 2 ignition coil device main body, 3 center core, 4 side core, 4*a* first core portion, 5 coil assembly, 6 elastic cover, 6*a* covering portion, 6*b* protruding portion, 6*c* side surface of protruding portion, 7 igniter, 7*a* projecting portion, 8 filler

The invention claimed is:

1. An ignition coil device for an internal combustion engine, comprising:

an insulating case;

an ignition coil device main body accommodated inside the insulating case, the ignition coil device main body including:

a coil assembly;

a center core arranged on an inner side of the coil assembly along a center axis of the coil assembly;

a side core arranged on an outer side of the center core and the coil assembly; and an elastic cover provided to the side core;

an igniter, which is accommodated inside the insulating case, and is configured to control energization of the coil assembly; and a filler, which is provided so as to fill the insulating case and is hardened, wherein the elastic cover includes:

a covering portion configured to cover the side core; and a protruding portion, which protrudes from the covering portion, and is configured to relax a stress generated in the filler.

2. The ignition coil device for an internal combustion engine according to claim 1, wherein the side core has first core portions arranged on the outer side of the center core in a direction of the center axis of the coil assembly, wherein the igniter is arranged on an outer side of a corresponding one of the first core portions in the direction of the center axis of the coil assembly, and wherein the protruding portion is arranged on a portion of the covering portion, which corresponds to the corresponding one of the first core portions.

3. The ignition coil device for an internal combustion engine according to claim 1, wherein, when the ignition coil device main body and the igniter are viewed along a direction of the center axis of the coil assembly, a part of the igniter projects beyond the covering portion as a projecting portion, and at least a part of the protruding portion overlaps with the projecting portion.

4. The ignition coil device for an internal combustion engine according to claim 3, wherein, when the ignition coil device main body and the igniter are viewed along the direction of the center axis of the coil assembly, the projecting portion entirely overlaps with the protruding portion.

5. The ignition coil device for an internal combustion engine according to claim 2, wherein the protruding portion has a plate-like shape, and wherein at least any one of side surfaces of the protruding portion is parallel to a surface of the igniter on the side core side.

6. The ignition coil device for an internal combustion engine according to claim 2, wherein the protruding portion is arranged so that a side surface of the protruding portion on the igniter side is offset from a surface of a portion of the covering portion, which corresponds to a side surface of the side core on the igniter side, toward the center core side.

7. The ignition coil device for an internal combustion engine according to claim 2, wherein the protruding portion is arranged so that a side surface of the protruding portion on the igniter side is flush with a surface of a portion of the covering portion, which corresponds to a side surface of the side core on the igniter side.

* * * * *